United States Patent [19]

Sandow

[11] 4,112,620

[45] Sep. 12, 1978

[54] SMOKE AND HEAT VENT

[75] Inventor: Kiyoshi Sandow, Baytown, Tex.

[73] Assignee: Plasteco, Inc., Houston, Tex.

[21] Appl. No.: 776,237

[22] Filed: Mar. 10, 1977

Related U.S. Application Data

[63] Continuation-in-part of Ser. No. 647,368, Jan. 8, 1976, abandoned.

[51] Int. Cl.[2] ..... E05F 15/20

[52] U.S. Cl. ..... 49/8; 49/31; 52/1

[58] Field of Search ..... 49/1, 2, 4, 7, 8, 31; 52/1

[56] References Cited

U.S. PATENT DOCUMENTS

| | | | |
|---|---|---|---|
| 3,399,500 | 9/1968 | Shapiro | 49/8 X |
| 3,589,065 | 6/1971 | Watson | 49/7 |
| 3,788,013 | 1/1974 | Veen, Jr. | 49/7 X |
| 3,908,309 | 9/1975 | Coulter et al. | 49/2 X |

*Primary Examiner*—Philip C. Kannan

*Attorney, Agent, or Firm*—Pravel, Wilson & Gambrell

[57] ABSTRACT

A new and improved smoke and heat vent including a frame assembly pivotally attached to a curb member adapted for placement on the roof of a building or the like. The frame assembly supports a dome-shaped cover and is movable between a closed, dome supporting position and an open, released position in which the dome-shaped cover is allowed to fall or slide downwardly by itself to clear an opening for the escape of heat and smoke under emergency conditions. The initial fall of the dome-shaped cover is retarded to remove any extra load such as snow on the cover and the cover is caught by several bands attached to the curb member so that it will not fall to a floor below.

16 Claims, 6 Drawing Figures

Fig. 3
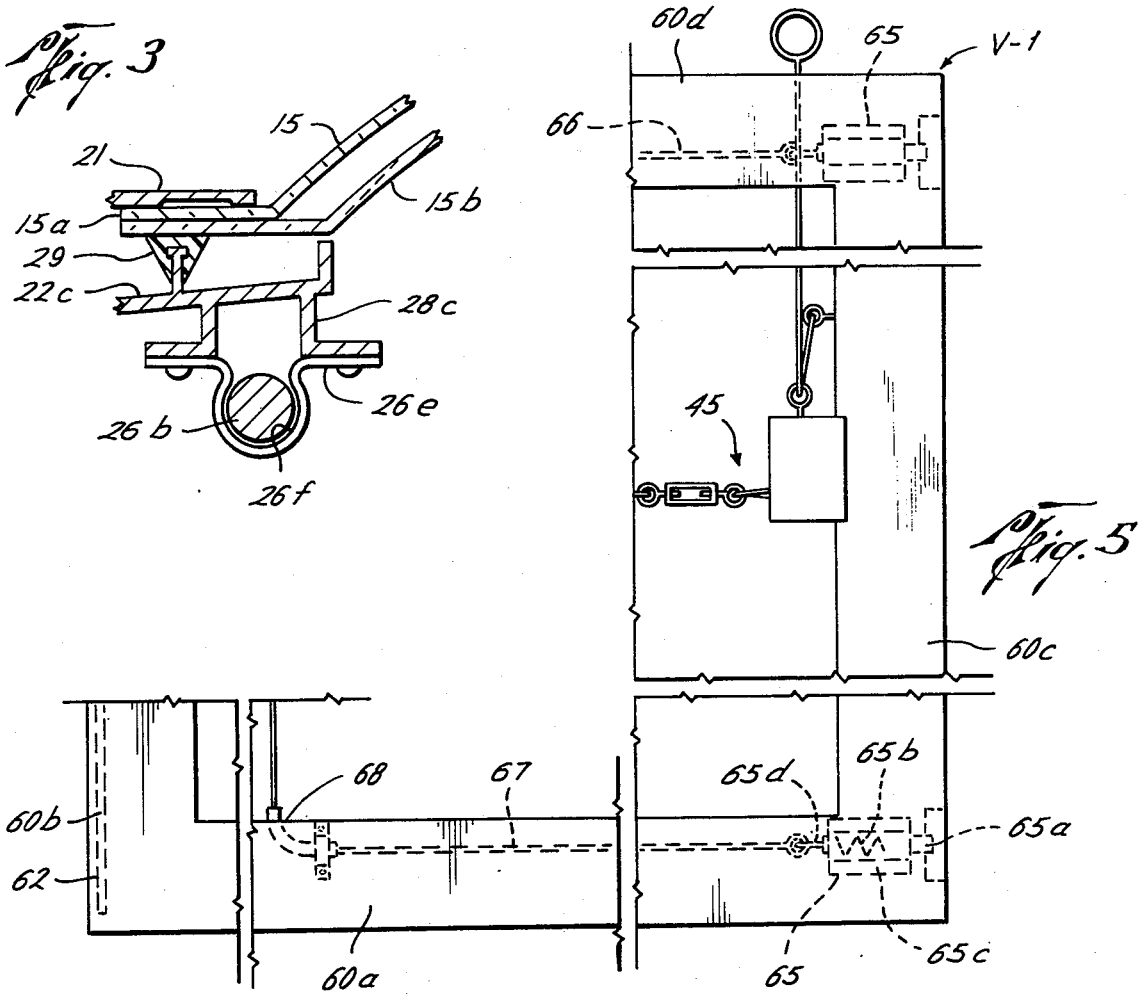
Fig. 5
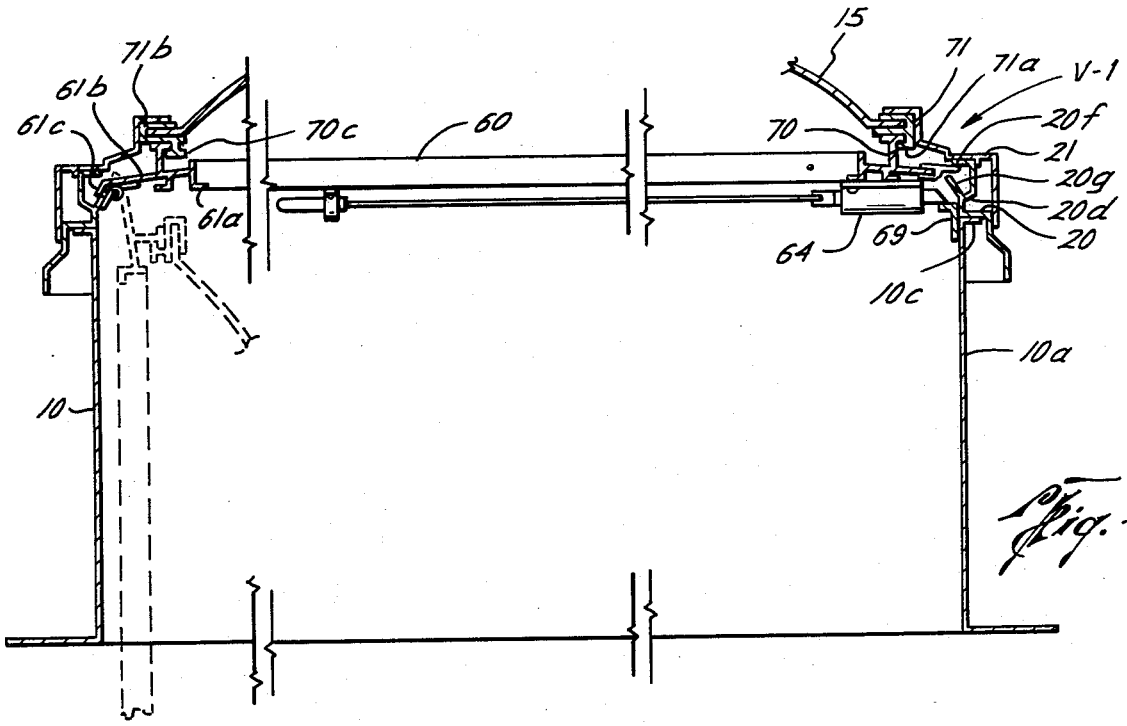
Fig. 4

SMOKE AND HEAT VENT

CROSS-REFERENCE TO RELATED APPLICATIONS

This application is a continuation-in-part of United States patent application Ser. No. 647,368 filed on Jan. 8,1976, and abandoned after the filing date of this application.

BACKGROUND OF THE INVENTION

The field of this invention is heat and smoke vents for the roof of a building or other structure.

Heat and smoke vents such as disclosed in U.S. Pat. No. 3,731,442 and 3,461,607 are designed to be mounted in the roof of a building or other structure for transmitting light under normal conditions; and, in the event of a catastrophe such as a fire, the heat and smoke vents are designed to provide an exhaust opening for the passage of heat and smoke from the building. In U.S. Pat. No. ;b 3,461,607 of Sandow, a heat and smoke vent is disclosed which includes a lifting means for lifting the cover of the heat and smoke vent upwardly in order to provide a heat escape opening. The lift mechanism in the Sandow U.S. Pat. No. 3,461,607 is actuated by a fusible link which releases the lifting mechanism to raise the cover after the receipt of a certain amount of heat. U.S. Pat. No. 3,788,013 of Veen, Jr. discloses a fire vent having a closure panel or partition which normally closes a tubular vent chamber or passage defined by an annular frame, with a support means for normally holding the closure in place, even against direct loading, but which collapses in response to the presence of heat, as from a fire, to drop the closure as well as certain support members out of the way to open up the tubular chamber and thus provide a vent. The support means includes a continuous rectangular upper support element which actually supports the closure or dome. A number of spaced lower supports are pivotally mounted on a cap portion and support the upper support element and thus the dome closure. The combination of the dome closure, the upper support member and the lower supports is not stable and will fall without further retention, which is provided by a cable which normally encircles a plurality of leverage arms attached to the lower supports. The cable has a heat sensitive link serially attached with it which, upon melting under heat, will release the cable and allow the lower supports, the upper support and the dome closure to fall downwardly.

Another type of heat and smoke vent uses a plastic cover which melts in response to certain temperature and heat conditions. The desirable aspect of this type of vent is that the cover is fully removed from the opening in order to allow for the escape of heat without obstruction from the raised framework and cover. However, the melt-type cover for a heat and smoke vent has disadvantages, also. The melt-type cover is generally considered to be very slow reacting because of the necessary passage of time before the entire cover melts sufficiently to soften enough to fall away. Further, for many types of melt-type covers, outside conditions such as extremely cold weather or rain may cause a cooling effect which neutralizes the rising heat from the fire in the building thereby preventing or delaying the melting of the cover and thus defeating the purpose of the entire unit. Another more inherent problem with any type of melt-type cover is that it cannot be quickly opened manually either from inside or outside; further, it cannot be used in conjunction with a smoke detector.

SUMMARY OF THE INVENTION

This invention is directed to a new and improved heat and smoke vent wherein the vent cover is releaseed to fall away from a supporting frame assembly in response to exposure to a certain amount of heat, smoke or other emergency condition in order to clear an opening for heat and/or smoke escape. In one embodiment of this invention, the cover is supported on a releasably-held cover frame assembly that drops away from a position in which the cover is supported to free the cover for falling. In another embodiment, the coversupporting frame assembly supports a cover for slidable movement downwardly to a substantially vertical position in order to clear an opening for heat escape.

For both embodiments, means are mounted with the vent cover to initially retard the fall of the dome as the vent cover is released in order to remove any extraneous load such as snow from the vent cover; and straps are mounted under the frame assembly to receive the falling vent cover.

These features and other features of the present invention will be described in more detail hereinafter. It should be understood that the summary of the invention just described is exemplary of some but not all of the features of this invention and that the claims for this invention are the only representative description of the actual scope of the invention claimed by Applicant.

BRIEF DESCRIPTION OF THE DRAWINGS

FIG. 3 is a sectional view taken along line 3—3 of FIG. 1 illustrating the positioning and operation of a latch member;

FIG. 4 is a side view partly in section of the second embodiment of this invention wherein the internal frame is a one-piece, square-shaped member illustrated in a horizontal closed position in real lines and in a vertical, open position in scored lines;

FIG. 5 is a top view of the embodiment of FIG. 4 with the cover and outer flashing removed to better illustrate the square-shaped frame assembly.

DESCRIPTION OF THE PREFERRED EMBODIMENT

Figure 2:
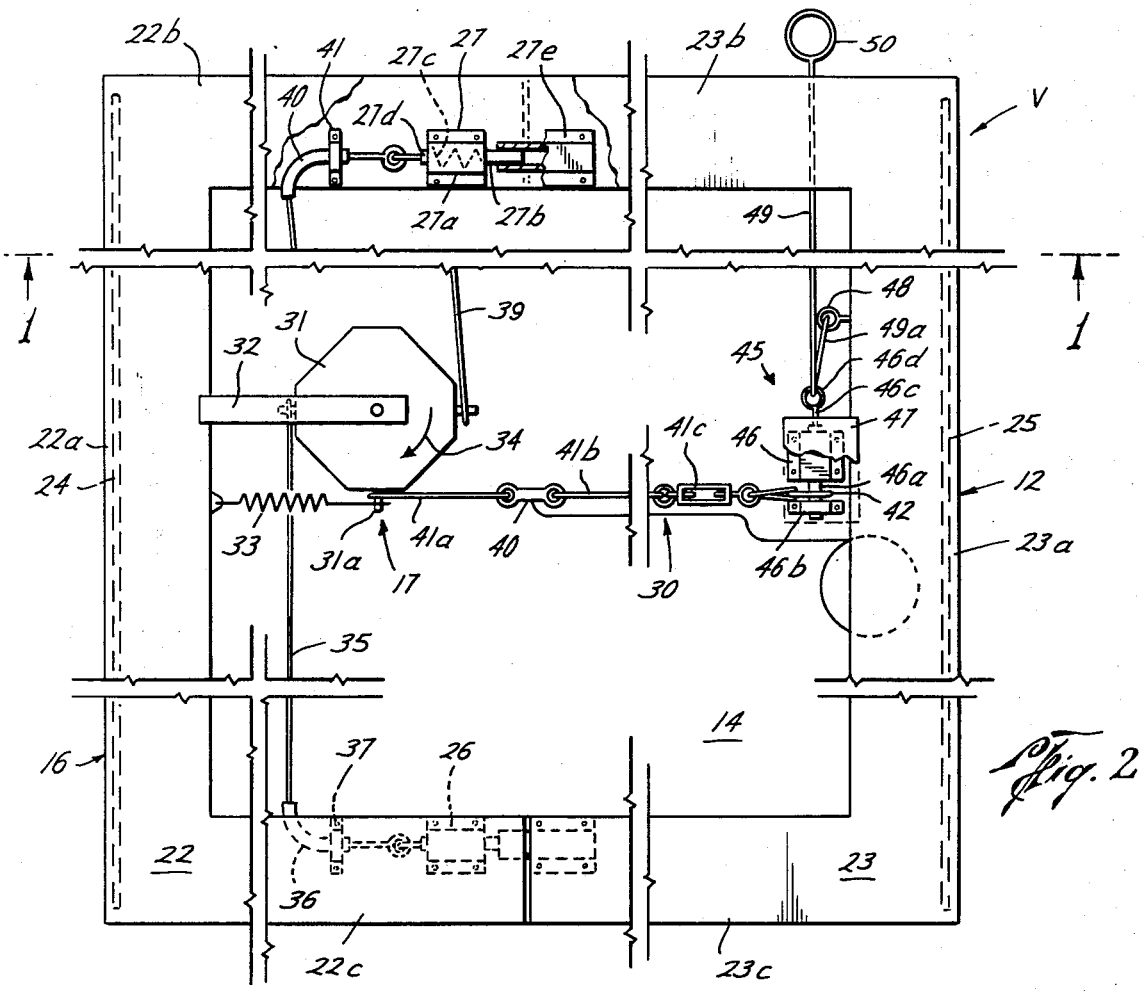
FIG. 2 is a top view of the U-shaped internal frame sections of FIG. 1 with the cover and outer flashing removed for clarity.

Referring to the drawings, new and improved heat and smoke vents V, V-1 and V-2 are illustrated. The heat and smoke vents V, V-1 and V-2 are adapted to be mounted in the roof of a building or other structure and are automatically openable downwardly to allow for the escape of heat and smoke in response to the receipt of a predetermined amount of heat or smoke or in response to another emergency condition.

Figure 1:
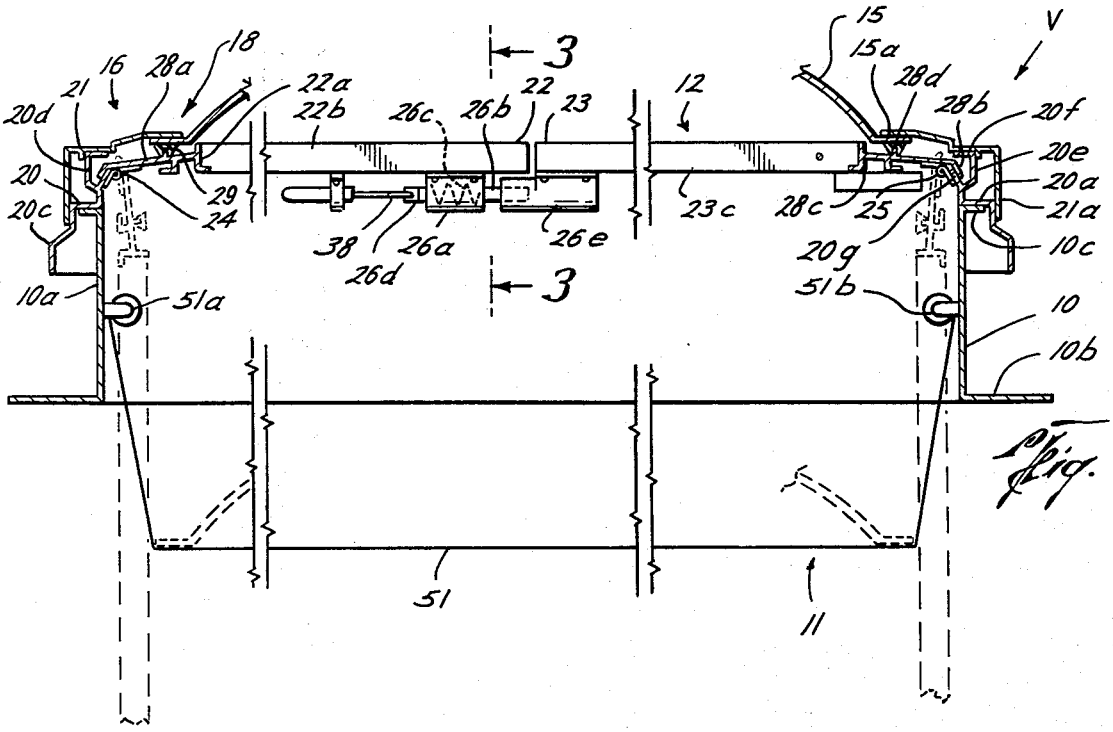
FIG. 1 is a side view partly in section taken along line 1—1 of FIG. 2 of the improved heat and smoke vent of the preferred embodiment of this invention illustrating the U-shaped, oppositely positioned internal frame sections in a closed, horizontal position in real lines and in a released, vertical position in scored lines.

Referring to FIGS. 1–3, the heat and smoke vent V basically includes a multi-sided curb member 10 which is adapted for placement in the roof of a building or other structure. The multi-sided curb member 10 has an opening 11 for providing communication between the inside and outside of the building or other structure. A multi-sided coversupporting frame assembly, generally designated by the number 12, is positioned within the curb member 10 and also has an opening 14 therein. A cover 15 is mounted over the multi-sided frame assembly 12 for normally preventing the passage of the elements such as rain from the outside to the inside of the building. The cover 15 may be of any desired shape. In the drawings illustrated, the cover 15 is domeshaped. The material for the cover 15 may be transparent or translucent plastic or other suitable material or may even be a metal if desired. Further, the cover may be single layer of plastic or a double layer such as is known in the art. Releasable mount means generally designated by the number 18 mount the cover 15 on frame assembly 12 for falling movement free of the frame assembly in response ot pivotal movement of the frame assembly downwardly. Mount means, generally designated by the number 16, are provided for mounting the frame assembly 12 for pivotal movement between a closed, normally horizontal position (illustrated in real lines in FIG. 1) and a down, substantially vertical position (illustrated in scored lines in FIG. 1). And, emergency release means, generally designated by the number 17, are mounted with the frame assembly 12 for automatically releasing the frame assembly for movement from the closed position to the open position in response to an emergency condition.

The multi-sided curb member 10 is actually square-shaped in the embodiment illustrated in the drawings and thus includes four sides or walls 10*a*. A bottom end flange 10*b* extends outwardly from the sides 10*a* for connection to the roof of the building or other structure; and, an upper end flange 10*c* extends horizontally outwardly from the top of the sides 10*a* and provides a supporting surface for the remainder of the vent V.

Referring to FIG. 1, a mounting curb frame 20 is mounted onto the upper end curb flange 10c for supporting the frame assembly 12 and the cover 15. Referring to the cross-sectional configuration of the curb frame member 20, a central portion 20*a* is positioned horizontally on top of the upper end curb flange 10*c* and a lower, outer end portion extends outwardly and downwardly therefrom and is identified by the number 20*c*. This lower depending end portion 20*c* provides a weepage or drainage route for water running downwardly from the cover 15 and an outer flashing 21. The curb frame further includes an inwardly and upwardly extending Y-shaped section or portion 20*d*. The Y-shaped portion 20*d* includes an outer branch 20*e* having an upper rim portion 20*f* adapted to support the outer flashing 21. An inner branch 20*g* of the Y-shaped portion 20*d* extends inwardly at an inclined angle with respect to the vertical.

The frame assembly 12 includes two, opposing U-shaped frame sections 22 and 23. The frame section 22 includes a central portion 22*a* which is connected to side frame portions 22*b* and 22*c*. The frame portion 22*a* is pivotally connected to the inner branch 20*g* of the curb frame 20 by a transversely extending hinge assembly 24.

Similarly, thhe U-shaped frame section 23 includes a central portion 23*a* which is joined to side portions 23*b* and 23*c*. The central frame portion 23*a* is pivotally connected to the inner branch 20*g* of the curb frame member 20 by a hinge assembly 25 extending transversely along the frame central portion 23*a* on the opposite side from hinge assembly 24.

The emergency release means 17 includes releasable latch assemblies 26 and 27 which support the U-shaped frame sections 22 and 23 in the substantially horizontal, closed position but upon release allow the U-shaped frame sections to pivot downwardly to the substantially vertical, open position to allow for the escape of heat and smoke.

Referring in particular to FIG. 1, the cross-sectional configuration of each of the portions such as 22*a*, 22*b* and 22*c* of both of the U-shaped frame members 22 and 23 is illustrated. A slightly inclined central frame portion 28*a* extends outwardly and terminates in a further downwardly inclined rim 28*b* mounted and positionable over the inner branch 20*g* of the Y-shaped inner curb frame portion 20*d*. A wing-shaped, botton section 28*c* is integrally formed at the inside of the frame portions for mounting the latch assemblies 26 and 27. An upwardly extending ridge 28*d* extends about all sides of the various frame portions to form a square-shaped, substantially continuous ridge for mounting a resilient gasket 29. The resilient gasket 29 supports the dome-shaped cover 15. Finally, the outer flashing, which has been designated by the number 21, is positionable over the outer edge 15*a* of the cover 15 and extends over and rests upon the upper rim 20*f* of the outwardly extending branch 20*e* of the Y-shaped portion 20*d* of the inner curb member 20. The flashing 21 includes a substantially vertically extending portion 21*a* which is adjacent to the downwardly extending portion 20*c* of the inner curb frame member 20 in order to provide for drainage flow for rain flowing from the cover 15 downwardly onto the roof of the structure.

The latch assembly 26 includes a hollow, cylindrical latch cartridge 26*a* which houses a bolt or latch bar 26*b* and urges the latch bar outwardly by means of a spring 26*c* properly positioned within the housing. A connecting shaft 26*d* extends through the cartridge 26*a* and is connected to the latch bar 26*b*. The cartridge 26*a* is mounted by suitable means onto the underside of the wing-shaped portion 28*c* of the frame section 22*c*. A lock sleeve or tube 26*e* is mounted onto the wing-shaped portion 28*c* of the frame portion 23*c* in alignment with the latch bolt 26*b* for receiving the latch bolt 26*b* and cooperating therewith to support the frame portions 22*c* and 23*c* in horizontal alignment with each other. Referring to FIG. 3, the configuration of the lock sleeve inner surface 26*f* is approximately complementary to the circular cross section of the latch bolt 26*b* for the purpose of being engaged by the latch bolt even in the upper portions of the inner surface for fully supporting the frame portions 22*c* and 23*c* in a horizontal position. In FIG. 3, the cover 15 illustrated is a double dome having a second layer 15*b*.

Similarly, the latch assembly 27 includes a hollow, cylindrical latch cartridge 27*a* mounted onto the wing-shaped portion 28*c* of the U-shaped frame portion 22*b*. A latch bolt or bar 27*b* is urged outwardly to the locked position illustrated in FIG. 1 by a suitable spring 27*c*. A connecting shaft 27*d* is attached to the latch bolt 27*b* and extends outwardly of the rear of the cartridge 27*a* for movement with the latch bolt. A locking tube 27*e* is mounted onto the underside of the wing-shaped portion of the frame section 23b in alignment with the latch bolt 27b in order to receive same. The configuration of the locking sleeve or tube 27e is identical to the tube 26e and thus provides support for the U-shaped frame portions 22b and 23b to hold them in horizontal alignment. In this manner, the latch assemblies 26 and 27 cooperate to hold the entire U-shaped frame sections 22 and 23 in aligned, horizontal positions under normal circumstances.

The emergency release means 17 includes an emergency condition responsive means 30 in operative connection with the latch assemblies 26 and 27 for releasing the latch assemblies 26 and 27 to allow the U-shaped internal frame sections 22 and 23 to pivot downwardly to an open position in response to an emergency condition. The emergency condition responsive means 30 includes an actuator plate 31 supported by arm 32 extending outwardly from the central portion 22a of the U-shaped frame section 22. A suitable pin mounts the actuator plate 31 for rotation in a plane substantially parallel to the plane formed by the frame portions 22a, 22b and 22c. A spring 33 is attached to a pin 31a extending radially outwardly from the actuator plate 31 and also to the frame portion 22a in order to continually urge the actuator plate in a direction of rotation identified by arrow 34. A cable 35 is attached to another radial pin on the actuator plate 31 and extends through a guide tube or sleeve 36, which is held in place by a bracket 37, into connection with the connector shaft 26d. The connection may be made by a ring 38 or other suitable means. Similarly, another cable 39 is attached to an actuator plate pin and extends through a guide tube 40 held in place by bracket 41 into attachment with the connector shaft 27d of the latch assembly 27. Therefore, whenever the actuator plate 31 is free to rotate in the bias direction 34, the cables 35 and 39 will withdraw the latch bolts 26b and 27b, respectively, out of the lock tubes 26e and 27e, respectively, thereby freeing the U-shaped frame sections 22 and 23 for downwardly movement to an open position.

The actuator plate 31 is held in a neutral position such as illustrated in FIG. 1 by a link 40 which is attached to the actuator plate pin 31a by a cable portion 41a. Another cable portion 41b is attached to the link 40 and extends into connection with a turnbuckle 41c which is connected to a ring 42. The link 40 may be made of any suitable material which will sufficiently melt after exposure to an emergency condition. If the emergency condition is temperature only, the link 40 may be one that melts at certain temperatures or in response to certain temperature increases. Such a link is available from Richards-Wilcox Manufacturing Company of Aurora, Ill. The emergency condition responsive means 30 may also use a link in combination with a smoke detector 30a to operate the latch assemblies 26 and 27 in response to certain smoke conditions. Smoke detectors are well-known in the art and are readily available to provide an electrical signal in response to a dangerous smoke condition. A link such as the ETL link sold by S. R. Products, Inc. of Mendenhall, Pa. may be used because the link will melt in response to the electrical signal sent by the smoke detector.

A manual release means generally designated by the number 45 serves to maintain the ring 42 in the position illustrated in FIG. 1 under normal circumstances. The manual release means includes a hollow, cylindrical cartridge 46 mounted onto a plate 47 extending from the frame portion 23a. The cartridge 46 mounts a latch bar or bolt 46a to extend outwardly by a suitable spring (not shown). A circular bracket 46b is mounted onto the plate 47 to receive the bolt 46a. The bolt 46a is inserted through the ring 42 prior to insertion through the circular bracket 46b in order to hold the ring 42, turnbuckle 41c, cable portion 41b, link 40 and cable portion 41a in a position illustrated in FIG. 1 until manual release is desired. A connecting shaft 46c is attached to the latch bolt 46a and extends rearwardly out of the cartridge and terminates in a ring 46d. A ring or eyelet 48 is attached to the frame portion 23a at the bottom thereof by any suitable means. A cable 49 is attached to the eyelet 48 and extends through the ring 46d and is attached thereto. The cable 49 extends from ring 46d through the U-shaped frame section 23b and outwardly between the weepage 20c of the inner curb frame member 20 and the vertical portion 21a of the outer flashing 21. In this manner, a user can manually release the actuator plate 31 and thus the latch assemblies 26 and 27 from above or below the vent V. The cable 49 terminates in the ring 50 outside of and above the roof of the building or other structure so that a person on the roof can pull the ring 50 and cause the cable 49 to pull inwardly the latch bolt 46a thereby releasing the ring 42 and thus the actuator plate for movement in the direction of arrow 34 due to the bias of the spring 33. Similarly, a user can pull the cable portion 49a located between the ring 46d and the stationary eyelet 48 from underneath the vent V in order to effect the same release.

Upon release of the latch assemblies 26 and 27, the U-shaped frame sections 22 and 23 are pivoted downwardly under the force of gravity to the substantially vertical, open position illustrated in scored lines in FIG. 2. As the U-shaped frame sections 22 and 23 swing downwardly, the cover 15 is released from its position between the outer flashing 21 and the gasket 29 and falls downwardly between the U-shaped frame sections 22 and 23.

One or more belts 51 are positioned below the U-shaped frame sections 22 and 23 in the horizontal position in order to catch the cover 15. Referring in particular to FIG. 1, one of the belts is illustrated from the side view. The belt 51 illustrated in FIG. 1 is attached to the same curb walls 10a to which the U-shaped frame members 22 and 23 are attached. The position of the one or more belts 51 is such that the arms or frame portions such as 22b and 22c swing to the outside of the belts 51 when the U-shaped frame sections such as 22 are released. Thus, when the U-shaped frame section 22 is in the down, open position illustrated in scored lines in FIG. 2, the belts are positioned between the frame portions 22b and 22c. The belts may be resiliently mounted by means of brackets 51a and 51b which are attached to the inside surfaces of the opposing curb member sides 10a. A suitable torsion-type spring (not shown) is mounted within a shaft held by the brackets 51a and 51b in order to engage and resiliently hold the belt 51 in a horizontal position. In this manner, whenever the top 15 falls downwardly, the belts will yield to insure that the cover 15 will not bounce off the belts.

The second embodiment V-1 of the new and improved heat and smoke vent of the preferred embodiments of this invention is illustrated in FIGS. 4 and 5. Since many of the structural elements are identical to the heat and smoke vent V already described, the same numbers and letters will be used to identify the same structure wherever possible. Referring now in particular to FIGS. 4 and 5, a multi-sided curb member 10 is again illustrated for mounting in a roof of a structure or building. An inner curb frame member 20 is mounted on the upper flange 10*c* of the curb sides 10*a*. The inner curb frame member 20 includes the inwardly extending branch 20*g* of the Y-shaped portion 20*d* previously described. The outer flashing 21 is again mounted on the upper inner curb frame member rim 20*f*. The principal difference between this embodiment of the heat and smoke vent V-1 and the embodiment V is in the structure and mounting of the frame assembly 60 of the embodiment V-1. The frame assembly 60 is a square-shaped unit having four sides 60*a*-d connected by suitable means so that the frame assembly moves as a unit. Referring to FIG. 5, the cross-sectional configuration of the frame assemblyy 60 is identical in configuration to the internal frame member such as 22 and thus includes a wing-shaped inner portion 61*a* and a slightly inclined downwardly extending outer flat portion 61*b* which terminates in a ledge or rim 61*c* which is normally positioned over the inner branch 20*g* of the inner curb frame member 20.

One side 60*b* of the square-shaped frame assembly 60 is mounted onto the inwardly extending branch 20*g* of the inner curb frame member 20 by a transversely extending hinge 62. The opposite side 60*c* has mounted at the corners thereof on the underside two latch assemblies 65. Each of these latch assemblies 65 includes a latch bolt 65*a* which is continually pushed outwardly by a suitable spring element 65*b* mounted within a cartridge 65*c*. A connecting shaft 65*d* is again attached to the latch bolt 65*a*. Cables 66 and 67 are attached to the connecting shaft 65*d* and extend through suitable guides 68 to a emergency condition responsive means 30 which has been previously described with respect to the smoke vent V-1. Further, the emergency condition responsive means 30 is connected to a manual release means 45 which is also identical to that previously described. A ledge 69 is mounted by welding or other suitable means onto the inside of the curb side 10*a* shown on the right-hand side of FIG. 5 for supporting the latch bolts 65*a* and thus for supporting the square-shaped frame 60 in a horizontal position. Whenever the element 40 of the emergency condition responsive means 30 melts, or the manual release means 45 is activated either above or below the vent V-1, the bolts 65*a* are pulled inwardly toward the cartridge 65*c* off of the ledge 69 thus allowing the square-shaped frame member to move to the open, downwardly vertical position illustrated in scored lines in FIG. 5. The cover 15 is mounted on a T-shaped portion 70 of the frame member portions 60*a*-*d* by a retainer 71. On the right frame side 60*c*, the retainer 71 has a depending external lip 71*a* that holds the cover 15 on the T-shaped portion 70 but will allow the cover to move downward under the influence of gravity. The side portions on frame sides 60 and 60*d* of the retainer 71 also have the external lip 71*a* so that the cover is mounted for slidable movement down the T-shaped portion 70 on frame portion 60 and 60d. The retainer portion 71*b* mounted on the left-hand side of T-shaped portion 70 on frame portion 60*b* has a first internal retainer lip 70*c* only (for engaging the underside of T-shaped portion 70) and no external lip so that the cover is free to slide downwardly of the frame 60 as the frame 60 is moved to the down position. The internal retainer lip 70*c* further includes a double lip portion providing a recess which is engaged by the T-shaped portion 70 on frame portion 60*c* as the cover slides downwardly off of the frame 60 so that the cover is caught on the frame 60 and does not fall downwardly into the building.

Figure 6:
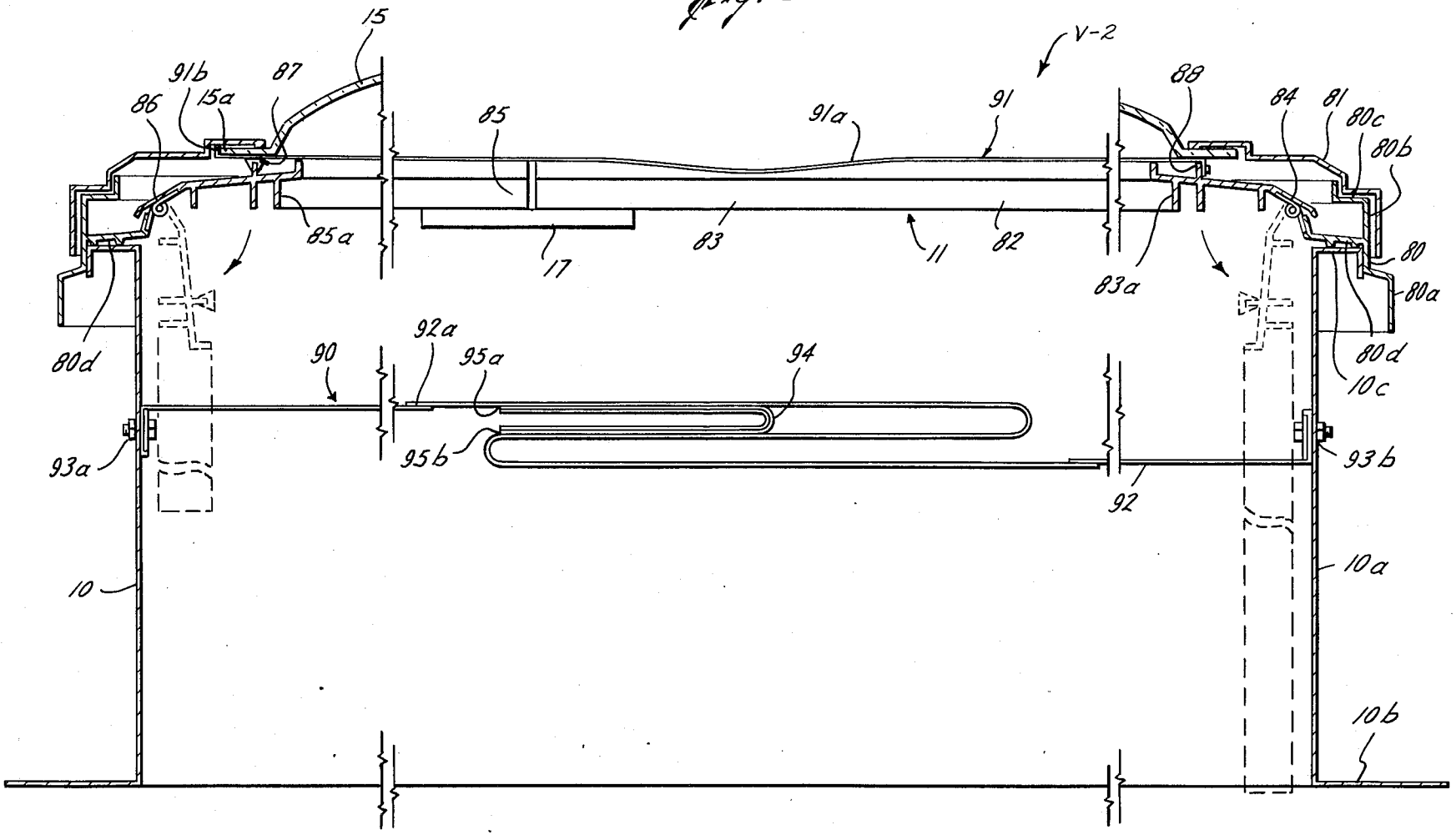
FIG. 6 is a side view partly in section of an improved heat and smoke vent having a structure similar to the vent of FIG. 1 and including bands attached to the frame assembly and held against the side of the vent cover ledge for initially impeding or retarding the fall of the vent cover to remove extraneous loads such as snow.

Referring to FIG. 6, a third embodiment V-2 for a heat and smoke vent is illustrated. Since many of the structural elements of the third embodiment for the heat and smoke vent V-2 are identical to the elements previously described in heat and smoke vents V and V-1, the same numbers and letters will be used whenever possible. A multi-sided curb member 10 is again illustrated for mounting in an opening in a roof of a building structure. The multi-sided curb member 10 includes four side walls 10*a* which form an approximate square. The side walls 10*a* terminate in a bottom flange 10*b* and in a top flange 10*c*. An inner curb member 80 is mounted onto the upper ledge 10*c*. The inner curb member 80 includes, as viewed in cross-section, three segments. A lower, depending segment 80*a* extends downwardly over the outside of the upper curb wall ledge 10*c*. An upwardly extending segment 80*b* includes an L-shaped end portion 80*c* which supports an outer flashing 81. Finally, a third segment 80*d* extends laterally inwardly from the connection of segments 80*a* and 80*b* and actually rests upon the upper curb side wall ledge 10*c*. The inner curb member 80 includes four side portions which cooperate to form a square configuration just as the curb member 10 forms a square configuration.

A frame assembly 82 includes a first U-shaped frame section 83 pivotally mounted by hinge 84 to inner curb member segment 80*d* and further includes a second U-shaped frame member 85 which is pivotally connected by another hinge 86 to the inner curb member segment 80*d* positioned on the opposite side wall from the first-mentioned curb segment 80*d*. The frame assembly sections 83 and 85 are each U-shaped and cooperate to form a square configuration having an internal opening therethrough. The U-shaped frame sections 83 and 85 are held in a horizontal, closed position by means of a suitable emergency release means such as the emergency release means 17 and latch assemblies 26 and 27 which has been previously described and is illustrated schematically only in FIG. 6.

A dome-shaped cover 15 is mounted onto a gasket 87 positioned on a vertical rim 88 extending upwardly from the various side members of the U-shaped frame sections 83 and 85. The dome-shaped cover 15 includes a lower rim or ledge 15*a* which actually rests on the gasket 87. The outer flashing 81 has a suitable configuration to extend over the inner curb frame member 80 and over the top of the cover ledge 15*a*.

The U-shaped frame sections 83 and 85 are mounted by hinges 84 and 86 for pivotal movement downwardly to approximately vertical positions in order to release the cover 15 for movement downwardly substantially out of the opening in order to allow heat and smoke to escape. As previously described, the emergency release means 17 is activated by sufficient heat or by sufficient smoke in the vicinity of the heat and smoke vent V-2.

Under certain conditions such as snow conditions, it is possible for additional weight to be placed upon the cover 15. For example, a large amount of snow may accumulate on top of the cover 15, this large amount of snow adds significant, extraneous weight to the cover 15. The amount of weight added by an accumulation of snow may be sufficient to cause resilient retention strap means such as 90 to break under the falling force or momentum of the combination weight of the cover and the collected snow. In order to prevent any failure of the resilient retention strap means 90, and in addition to reduce the possibility of the falling cover 15 from bouncing off of the retention strap means 90, fall retard means 91 are attached to one side 83*a* of the frame section 83 and are further temporarily held against the cover ledge 15*a* for the purpose of initially impeding or retarding the fall of the cover 15. The fall retard means 91 include one or more bands 91*a* which are attached to one side 83*a* of the frame section 83 by a series of screws extending through the bands 91*a* into the upwardly extending rim portion 88. The connection of the bands 91*a* to frame side 83*a* may be by other means such as rivets. The bands 91*a* extend from the frame section 83*a* across to opposite frame portion 85*a* of the U-shaped frame section 85. The bands 91*a* extend between the gasket 87 and the cover ledge 15*a* and terminate in an L-shaped end section 91*b* which extends up the side of the cover ledge 15*a*, but is not permanently attached thereto. The L-shaped end portion 91*b* terminates in a vertical lip which fits against the side of the cover ledge 15*a*. The bands 91*a* are not tautly attached between rim 88 of frame portion 83*a* and the cover ledge 15*a* mounted on frame portion 85*a*; however, the bands may be tautly extended between the frame section portions 83*a* and 85*a*.

Upon release by the release means 17 due to heat or smoke, the U-shaped frame sections 83 and 85 are released for pivotal movement downwardly to vertical positions against the curb side walls 10*a*. Pivotal movement downwardly of the frame sections 83 and 85 releases the cover 15 for falling movement downwardly through the roof opening. However, the fall retard bands 91*a* act to temporarily retard, halt and/or impede the fall of the cover 15. This temporary halt or abrupt slow down in the fall of the cover 15 due to the holding action of the bands 91*a* serves to jolt or bump the snow load off of the cover 15 thereby eliminating the extra weight due to the snow load. The L-shaped band connection end 91*b* will release or fail by bending outwardly due to the falling weight of the cover 15 such that the cover is then entirely free to fall onto the resilient retention strap means 90. The lip of band connection 91*b* serves to temporarily hold the falling cover 15, which will lose the snow load. The cover may even be turned over by the L-shaped connection, which obviously dumps the snow load. The bands 91*a* may be made out of an aluminum or other metal or material sufficiently thick to provide a temporary attachment to the cover 15 on end 91*b* in order to slow down the fall of the cover 15 sufficiently to jolt or flip off the snow load.

The resilient retention strap means 90 includes one or more straps 92 which include a basically non-resilient material strip 92*a* which extends from bolted connection 93*a* on one curb side wall to bolted connection 93*b* on an opposite curb side wall 10*a*. The overall length of the substantially non-resilient strap member 92*a* is substantially longer than the actual distance between the opposing curb side walls 10*a* to which the strap member 92*a* is attached. An intermediate resilient section 94 is attached to the underside of the strap member 92*a*. The overall length of the resilient section 94 is substantially less than the length of the portion of the strap member to which the resilient section 94 is connected. The resilient section 94 is stitched underneath the strap 92*a* and terminates at points 95*a* and 95*b*. The length of the resilient section 94 connected or extending between strap points 95*a* and 95*b* is substantially less than the length of actual strap material 92*a* extending between the points 95*a* and 95*b*. In this manner, the resilient section 94 serves to provide a partial shock absorber to the impact of the falling cover on the straps 92*a*. It is anticipated that in many cases, the resilient section 94 will serve to actually support the falling cover in cooperation with the actual strap 92*a*. However, there may be cases when the falling velocity of the cover 15 is sufficient to cause the resilient section 94 to fail. But if such resilient section 94 fails, the remainder of the actual strap 92*a* will be intact to hold the cover 15, whose velocity has been reduced due to the initial catching of the cover by the resilient section 94.

The foregoing disclosure and description of the invention are illustrative and explanatory thereof, and various changes in the size, shape and materials as well as in the details of the illustrated construction may be made without departing from the spirit of the invention.

I claim:

1. A new and improved heat and smoke vent adapted to be mounted with an opening in the roof of a building or the like, comprising:

a cover-supporting frame assembly having an opening therein and being adapted for mounting over an opening in the roof of a building or the like;

a cover positioned on said frame assembly;

said frame assembly including a frame section and frame mount means mounting said frame section for pivotal movement between a first, horizontal position for supporting said cover and a second, vertical position;

emergency release means mounted with said frame section for releasing said frame section from said first horizontal position under emergency conditions in order to allow said frame section to pivotally move downwardly; and said frame section, frame mount means, cover and emergency release means allowing said cover to fall away from said frame section for releasing said cover only for falling movement downwardly at least partially out of said roof opening in response to pivotal movement downwardly of said frame section in order to allow heat and smoke to pass out of such building.

2. The structure set forth in claim 1, wherein said frame mount means includes:

means for permanently, pivotally connecting said frame section for pivotal movement whereby only said cover is released for falling movement downwardly out of said roof opening.

3. The structure set forth in claim 1, including:

means mounting said cover for releasable, slidable movement downwardly out of said frame section as said frame section is pivotally moved downwardly to said second position.

4. The structure set forth in claim 1, wherein said emergency release means includes:

releasable latch means for releasably holding said frame section in said first position; and condition sensitive means releasing said latch means to allow said frame section to move downwardly to said second position in response to a predetermined emergency condition.

5. The structure set forth in claim 1, wherein said emergency release means includes:

releasable latch means releasably holding said frame section in said closed position; and temperature means for releasing said latch means to allow said frame section to pivot downwardly to said second position in response to a predetermined temperature or heat condition.

6. The structure set forth in claim 1, wherein said emergency release means includes:

releasable latch means releasably holding said frame section in said closed position; and smoke-sensitive means for releasing said latch means to allow said frame section to pivot downwardly to said second position in response to a predetermined smoke condition.

7. The structure set forth in claim 1, including:

said frame section is formed of two opposing U-shaped frame members, and said mount means pivotally mount said opposing U-shaped frame members oppositely to each other on said roof opening for pivotal movement between said first, horizontal position and said second, down position; and releasable latch means mounted with said U-shaped frame sections for holding said U-shaped frame sections in said first position.

8. The structure set forth in claim 1, including:

catch means positioned below said frame assembly for catching said cover and preventing said cover from falling further downwardly.

9. The structure set forth in claim 8, wherein said catch means includes:

a plurality of belts attached to said frame assembly below said opening for catching said cover.

10. The structure set forth in claim 1, including:

first and second manual release means located for placement inside and outside such building for manually releasing said frame section for movement downwardly as desired.

11. The structure set forth in claim 7, including:

said releasable latch means being mounted with said U-shaped frame members and including latch bolts mounted on one of the U-shaped frame members, said latch bolts being spring biased to extend into engagement with latch sleeves mounted on the other of said U-shaped frame members;

a cable operatively connected to each of said latch bolts and extending to connection with an actuator member which is mounted to said one of said U-shaped members for rotation with respect thereto;

a spring attached to said one of said U-shaped members and to said actuator member for urging said actuator member in a direction of rotation that pulls said cables and said bolts connected therewith out of said latch sleeves whereby said U-shaped frame members are allowed to pivot to said second position; and a releasable link attached to said actuator member in a neutral position against the force of said spring, said link melting in response to an emergency condition.

12. The structure set forth in claim 1, including:

fall retard means mounted with said frame section and with said cover for temporarily impeding the fall of said cover in order to remove extraneous loads such as snow load from said cover.

13. The structure set forth in claim 12, including:

a plurality of bands permanently attached to said frame section on one end and extending across said opening into temporary engagement with said cover in order to temporarily impede the fall of said cover from said frame section to cause an extraneous load such as a snow load to be at least partly removed from said cover prior to said cover being fully freed to fall downwardly through said opening.

14. The structure set forth in claim 12, including:

yieldable strap assemblies mounted with said frame assembly below said frame section in order to catch said falling cover after at least temporarily yielding under the initial momentum of said cover to prevent said cover from bouncing off of said strap assemblies and to prevent said strap assemblies from failing.

15. A new and improved heat and smoke vent adapted to be mounted with an opening in a roof of a building or the like, comprising:

a cover supporting frame assembly having an opening therein and being adapted for mounting over an opening in a roof of a building or the like;

a cover positioned on said frame assembly;

emergency release means for maintaining said frame assembly with said cover thereon in a first position under normal conditions and for releasing said frame assembly and cover for movement at least partly out of said roof opening under emergency conditions in order to allow heat and smoke to pass out of such building or the like; and fall retard means mounted with said frame assembly for temporarily attaching said cover to said frame assembly and for releasing said cover for falling movement downwardly away from said frame assembly after temporarily impeding the fall of said cover in order to remove extraneous load such as snow load.

16. The structure set forth in claim 15, including:

said fall retard means includes a plurality of bands including means for permanently attaching said bands to said frame assembly on one end and means for temporarily holding said bands against said cover on the other end thereof.

* * * * *